US007997578B2

(12) United States Patent
Saito et al.

(10) Patent No.: US 7,997,578 B2
(45) Date of Patent: Aug. 16, 2011

(54) RECORDING APPARATUS WITH REMOVABLE STACKER

(75) Inventors: Yusuke Saito, Nagano-ken (JP); Junya Kato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/843,460

(22) Filed: Jul. 26, 2010

(65) Prior Publication Data

US 2011/0024975 A1 Feb. 3, 2011

(30) Foreign Application Priority Data

Aug. 3, 2009 (JP) ..... 2009-180370

(51) Int. Cl.
*B65H 31/04* (2006.01)

(52) U.S. Cl. ..... 271/213; 271/207

(58) Field of Classification Search ..... 271/207, 271/209, 213, 405
See application file for complete search history.

(56) References Cited

U.S. PATENT DOCUMENTS

| | | | | |
|---|---|---|---|---|
| 1,228,750 | A * | 6/1917 | Crittenden | 271/213 |
| 6,568,865 | B1 * | 5/2003 | Fujioka et al. | 400/647.1 |
| 7,621,527 | B2 * | 11/2009 | Van Gerven et al. | 271/207 |
| 2006/0244208 | A1 * | 11/2006 | Kubota et al. | 271/207 |
| 2008/0252948 | A1 | 10/2008 | Onishi | |

FOREIGN PATENT DOCUMENTS

| | | | |
|---|---|---|---|
| EP | 2 053 566 | B1 | 4/2009 |
| JP | 63041348 | A * | 2/1988 |
| JP | 2002-187664 | | 7/2002 |
| JP | 2008-281549 | | 11/2008 |
| JP | 2009-098930 | | 5/2009 |

* cited by examiner

*Primary Examiner* — Jeremy R Severson

(57) ABSTRACT

A recording apparatus has a stacker that receives a discharged recording medium. An engagement mechanism removably attaches the stacker to a discharge section of the apparatus and includes a first engagement portion provided in the discharge section; a second engagement portion, on the stacker, that engages with the first engagement portion; and a guidance portion that guides the second engagement portion into the first engagement portion and extends in an upward direction. The second engagement portion is biased, by a biasing unit on the stacker, in the upward direction so as to move in the guidance portion. When an external force that opposes the biasing force is applied to the stacker and that external force is released, the second engagement portion rises due to the biasing force, is guided by the guidance portion, and engages with the first engagement portion.

6 Claims, 9 Drawing Sheets

RECORDING APPARATUS WITH REMOVABLE STACKER

CROSS-REFERENCE TO RELATED APPLICATIONS

Japanese Patent Application No. 2009-180370 is hereby incorporated by reference in its entirety.

BACKGROUND

1. Field of Invention

The present invention relates to recording apparatuses.

2. Description of Related Art

Ink jet printers, such as that disclosed in JP-A-2008-281549 and described below, are known as recording apparatuses that carry out recording processes on a recording medium.

JP-A-2008-281549 discloses a large-format ink jet printer (LFP), which is capable of, for example, performing printing processes using comparatively large-size recording paper (for example, JIS A1, JIS B1, and so on) as the recording medium. This ink jet printer includes a recording head capable of moving back and forth in a sub direction, which is orthogonal to the transport path of the recording paper, and the printing process is carried out by ejecting ink onto the recording paper from this recording head. Printing paper that has undergone the printing process is then continuously discharged from the printer, falls into a receptacle (a stacker) provided therebelow, and is held in a stacked state.

Incidentally, there are two types for the stacker provided in such ink jet printers, or a rear type, such as that disclosed in JP-A-2008-281549, and a front type, which is the opposite of the rear type. With a rear type stacker, the recording surface side of the paper, onto which the recording process has been carried out, rubs against the stacker as the paper is stacked, and thus there is the concern that abrasions and so on will occur in the recording surface. Accordingly, from the standpoint of protecting this recording surface, it is preferable to employ a front type stacker; however, it is necessary to attach front type stackers to the front side of the ink jet printer, which makes it necessary to provide a wide clearance. Thus, in the past, a system in which the stacker is attached to the ink jet printer only when the stacker is necessary has been employed, but this too has been problematic in that attaching such a large-size stacker is an extremely complicated process.

SUMMARY OF INVENTION

An advantage of some aspects of the invention is to provide a recording apparatus to which a large-sized stacker can be attached with ease.

An aspect of the invention is a recording apparatus having a discharge section that discharges a recording medium that has undergone a recording process and a stacker that receives the recording medium discharged from the discharge section, the recording apparatus including an engagement mechanism that attaches the stacker to the discharge section in a removable state. The engagement mechanism has a first engagement portion provided in the discharge section; a second engagement portion, provided in the stacker, that engages with the first engagement portion; and a guidance portion that guides the second engagement portion into the first engagement portion and extends in at least an upward direction. The second engagement portion is biased, by a biasing unit provided in the stacker, in the upward direction so as to move in the guidance portion; and when an external force that opposes the biasing force of the biasing unit is applied to the stacker and that external force is released, the second engagement portion rises due to the biasing force, is guided by the guidance portion, and engages with the first engagement portion.

By employing such a configuration, according to the invention, the second engagement portion provided in the stacker is caused to rise and engage with the first engagement portion provided in the discharge section using the biasing force that opposes the external force applied to the stacker, thus positioning and attaching the stacker to the discharge section.

According to another aspect of the invention, the stacker includes a frame structure provided with a first grounded frame, one end of which makes contact with the ground, and a second grounded frame, one end of which makes contact with the ground, that intersect with each other, the grounded frames being connected to each other so as to be capable of freely rotating central to an axis at the point of intersection; and the biasing unit includes an elastic structure member, constructed between the first grounded frame and the second grounded frame, that instigates the biasing force so that the other end of the first grounded frame rises.

By employing such a configuration, according to the invention, when the external force is applied to the frame structure from above, the frame structure is capable of moving so that the first grounded frame and the second grounded frame open. When a space opens between the first grounded frame and the second grounded frame, a tensile force arises in the elastic structure member erected therebetween, and the opposing force (that is, the restitution force) of the elastic structure member acts between the first grounded frame and the second grounded frame. By using this restitution force, the second engagement portion provided in the stacker is caused to rise and engage with the first engagement portion provided in the discharge section, thus positioning and attaching the stacker to the discharge section.

According to another aspect of the invention, the second engagement portion is provided in one of the first grounded frame and the second grounded frame.

By employing such a configuration, according to the invention, when one of the grounded frames is moved by applying an external force from thereabove, the other grounded frame also moves at the same time due to the effects of the frame structure, and it is thus possible to easily move the second engagement portion by operating the grounded frame on the opposite side of the grounded frame in which the second engagement portion is provided.

According to another aspect of the invention, an insertion section of the guidance portion, into which the second engagement portion is inserted, is located at a predetermined height; and the elastic structure member includes a regulation portion that regulates the rotational amount of the second grounded frame relative to the first grounded frame so that the height of the second engagement portion when the external force is applied thereto is the same as the height of the insertion section.

By employing such a configuration, according to the invention, the regulation portion regulates the amount by which the stacker is depressed when the external force is applied to the stacker; as a result, the insertion section of the guidance portion and the second engagement portion are at the same height when the stacker has been depressed, making it possible to smoothly insert the second engagement portion into the guidance portion.

According to another aspect of the invention, the insertion section of the guidance portion, into which the second engagement portion is inserted, is formed so that the width of the guidance portion gradually increases toward an entry side into which the second engagement portion enters.

By employing such a configuration, according to the invention, it is easy to insert the second engagement portion into the insertion section, and it is possible to smoothly guide the second engagement portion along the guidance portion.

BRIEF DESCRIPTION OF THE DRAWINGS

The invention will be described with reference to the accompanying drawings, wherein like numbers reference like elements.

DESCRIPTION OF THE PREFERRED EMBODIMENTS

Figure 1:
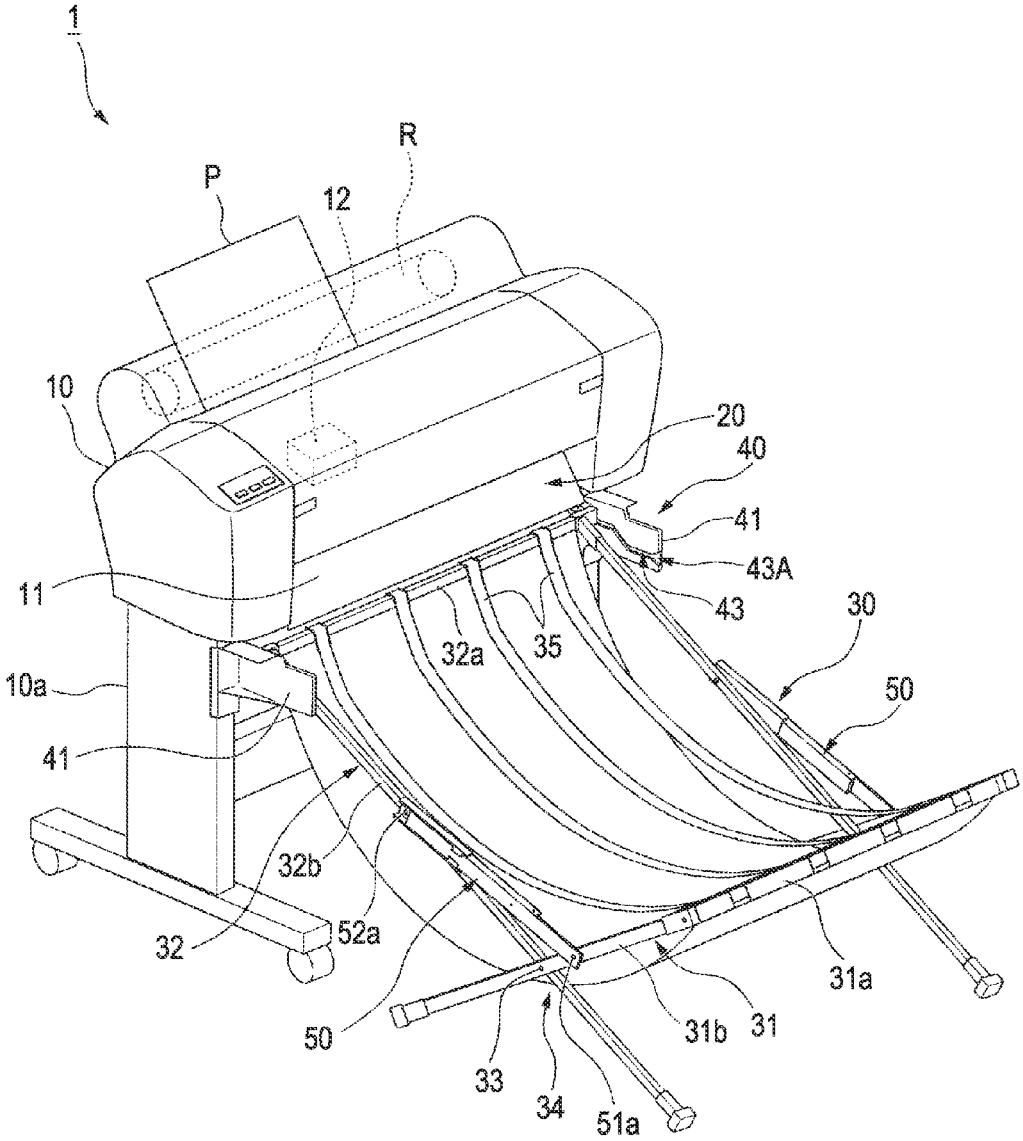
FIG. 1 is a perspective view of an ink jet printer according to an embodiment of the invention.

An embodiment of a recording apparatus according to the invention will be described hereinafter with reference to the drawings. It should be noted that in the drawings used in the following descriptions, the scale of the various constituent elements has been changed in order to achieve sizes that are more visibly recognizable. This embodiment discusses, as the recording apparatus according to the invention, a large-format ink jet printer (LFP), which is capable of, for example, performing printing processes using comparatively large-size recording paper (for example, JIS A1, JIS B1, and so on) as the recording medium.

FIG. 1 is a perspective view of an ink jet printer 1 according to an embodiment of the invention.

The ink jet printer 1 includes a main printer unit 10 that performs a printing process on recording paper P. The main printer unit 10 is supported at a predetermined height by a pair of leg portions 10*a*. The main printer unit 10 includes a transport path 11 that transports the recording paper P at a slanted angle of approximately 60° and a recording head 12 that is capable of moving back and forth in a sub direction of the transport path 11, which is the direction orthogonal to the transport direction of the recording paper P. A spindle capable of holding a paper roll R is provided in a rear section of the main printer unit 10. The transport path 11 includes multiple transport rollers (not shown) that transport the recording paper P by pinching the recording paper P and undergoing rotational driving.

The recording head 12 is mounted in a carriage (not shown) capable of moving in the sub direction of the transport path 11. The recording head 12 includes multiple nozzle rows, and the configuration is such that inks of predetermined colors (for example, yellow (Y), magenta (M), cyan (C), and black (K)) can be ejected from respective nozzle rows. The recording head 12 executes a recording process, in which information such as predetermined images, text, and the like is recorded onto a recording surface of the recording paper P that is transported along the transport path 11 by ejecting ink onto the recording surface. The recording paper P that has undergone the recording process is discharged from a discharge section 20 of which the end portion of the transport path 11 is configured. Note that in the following descriptions, the front side in the discharge direction of the recording paper P is sometimes referred to as the "leading side", whereas the rear side in the discharge direction of the recording paper P is sometimes referred to as the "following side".

The ink jet printer 1 includes a stacker 30 that receives the recording paper P that has been discharged from the discharge section 20, and an engagement mechanism 40 that attaches the stacker 30 to the discharge section 20 in a detachable state. Characteristic configurations of the stacker 30 and the engagement mechanism 40 according to the invention will be described hereinafter.

Figure 2:
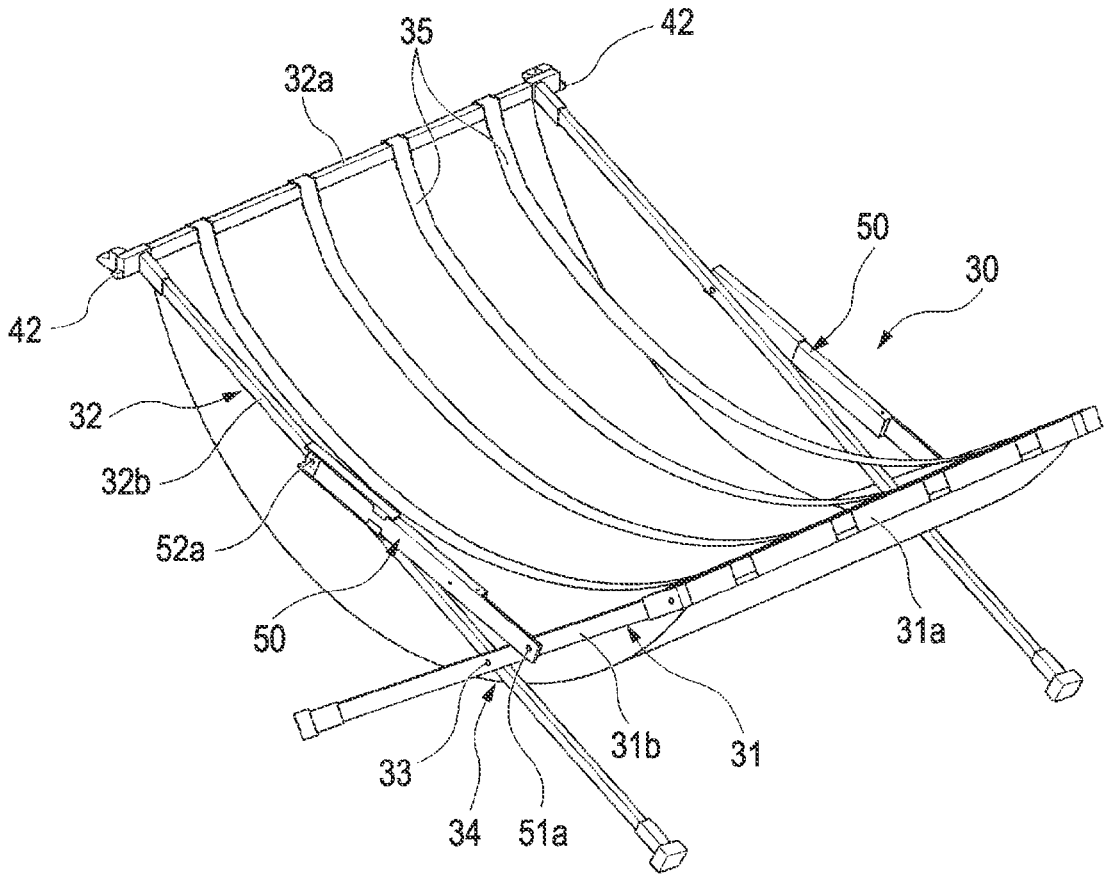
FIG. 2 is a perspective view of a stacker according to an embodiment of the invention.
Figure 3:
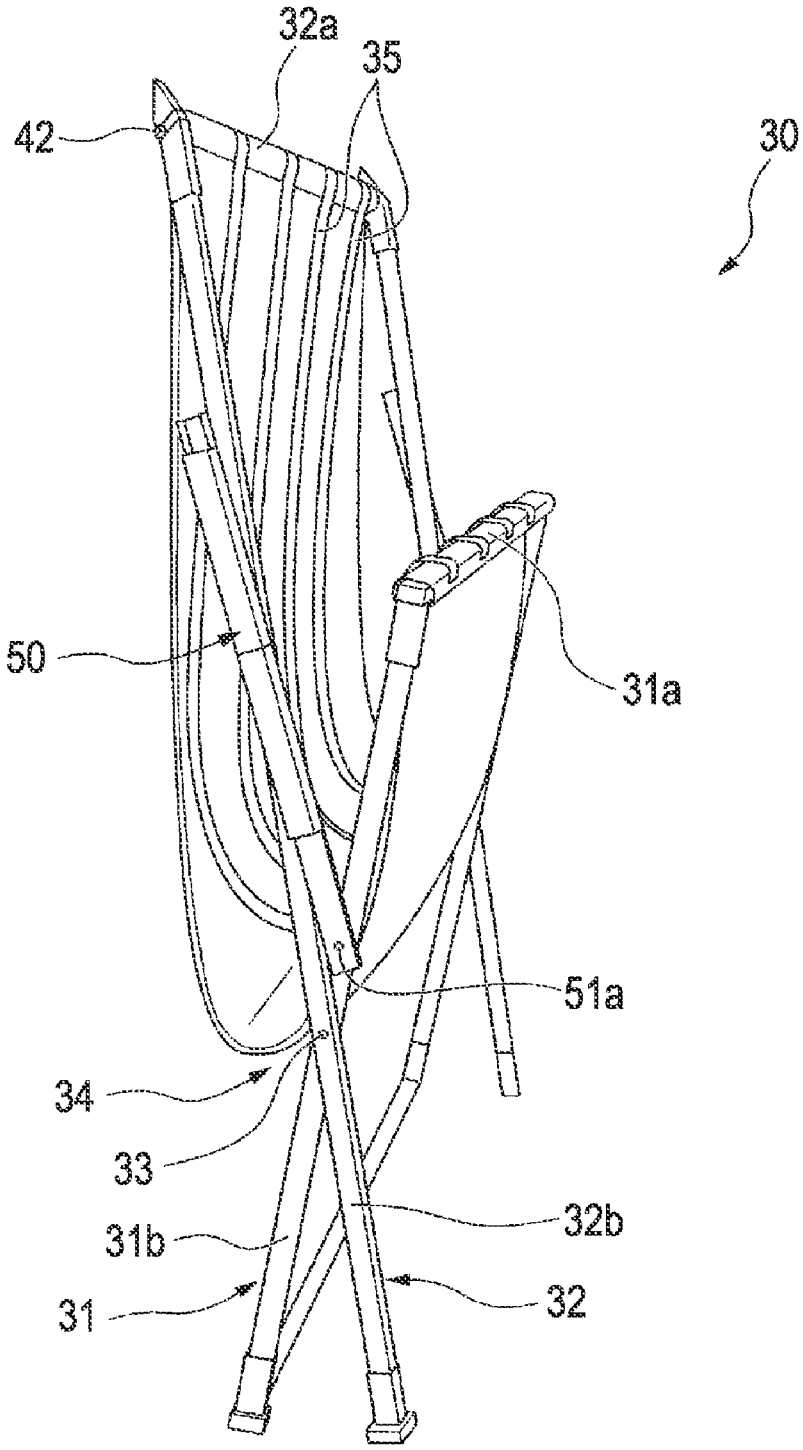
FIG. 3 is a perspective view illustrating a folded-up state of a stacker according to an embodiment of the invention.
Figure 4:
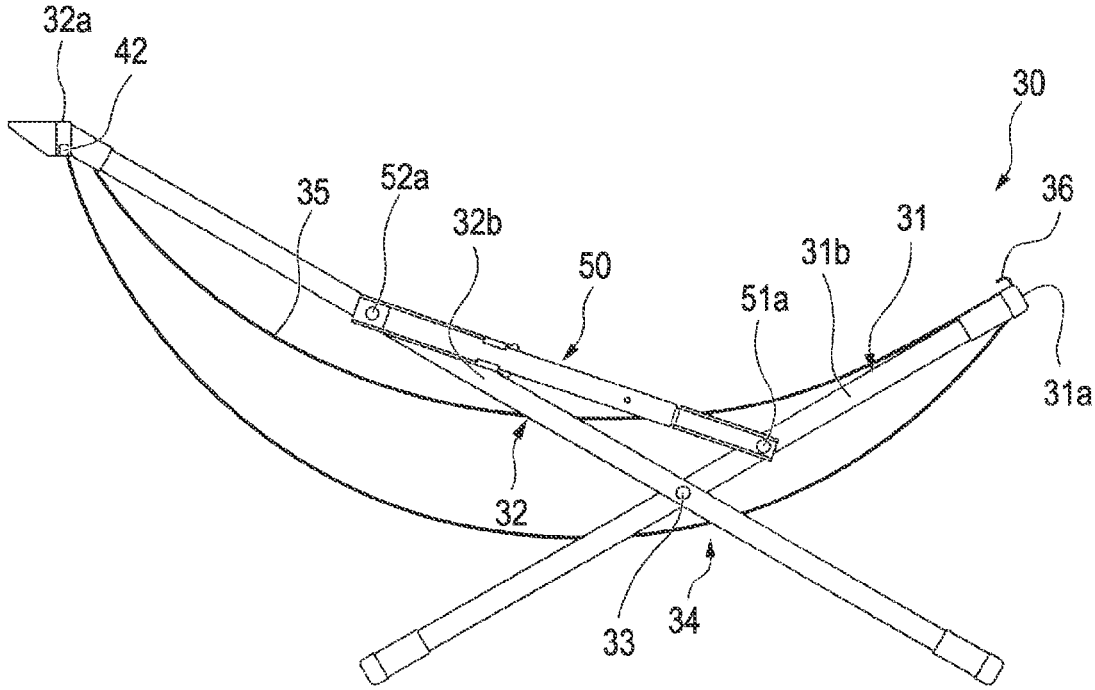
FIG. 4 is a side view of a stacker according to an embodiment of the invention.

FIG. 2 is a perspective view of the stacker 30 according to this embodiment of the invention. FIG. 3 is a perspective view illustrating a folded-up state of the stacker 30 according to this embodiment of the invention. FIG. 4 is a side view of the stacker 30 according to this embodiment of the invention.

The stacker 30 is a front type stacker that holds the recording paper P discharged continuously from the discharge section 20 of the main printer unit 10 in a stacked state. As shown in FIG. 2, the stacker 30 includes a frame structure 34 provided with a first grounded frame 31 and a second grounded frame 32 that intersect with each other, and linking shafts 33 provided in the positions where the two frames intersect so as to link the frames in a state in which both frames can freely rotate central to an axis that extends in the horizontal direction thereof. The first grounded frame 31 has an approximately quadrangular square shape, whereas the second grounded frame 32 is generally shaped like a square with one side open. The stacker 30 is configured so as to be capable of being folded up when not in use by rotating the first grounded frame 31 and the second grounded frame 32 central to the linking shafts 33 (see FIG. 3).

Returning to FIG. 2, multiple band members 35, which support the recording paper P from the surface opposite to the recording surface, are erected between an upper frame section 31*a* of the first grounded frame 31 and an upper frame section 32*a* of the second grounded frame 32 at predetermined intervals. The band members 35 are arranged at an interval that is capable of handling multiple types of recording paper P, and in this embodiment, four band members 35 are provided. The band members 35 are configured of a flexible high-polymer film material, and as shown in FIG. 4, are configured so as to sag between the upper frame section 31*a* and the upper frame section 32*a*, thus forming a slight inclination, which reduces the discharge speed of the recording paper P that has been discharged. Meanwhile, a hook 36 is provided in the upper frame section 31*a*, and is configured so as to suppress the recording paper P from escaping.

The engagement mechanism 40 includes attachment frames (first engagement portions) 41 provided on each side of the discharge section 20, as shown in FIG. 1, and bosses (second engagement portions) 42, which engage with the attachment frames 41, provided on each side of the upper frame section 32*a* of the stacker 30, as shown in FIG. 2.

Figure 5:
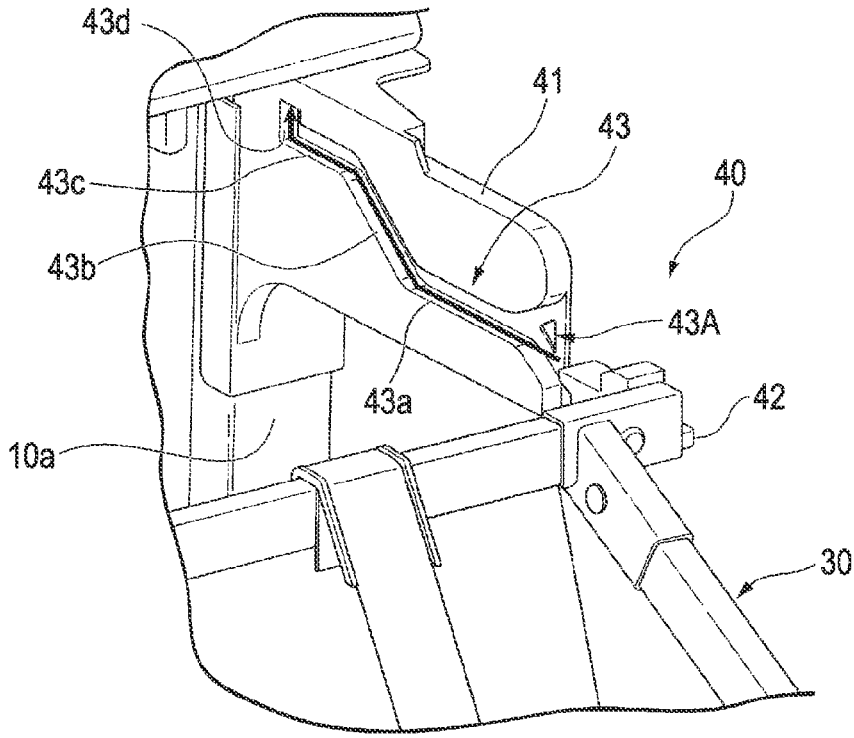
FIG. 5 is a diagram illustrating a state prior to an attachment frame and a boss being engaged with each other, according to an embodiment of the invention.
Figure 6:
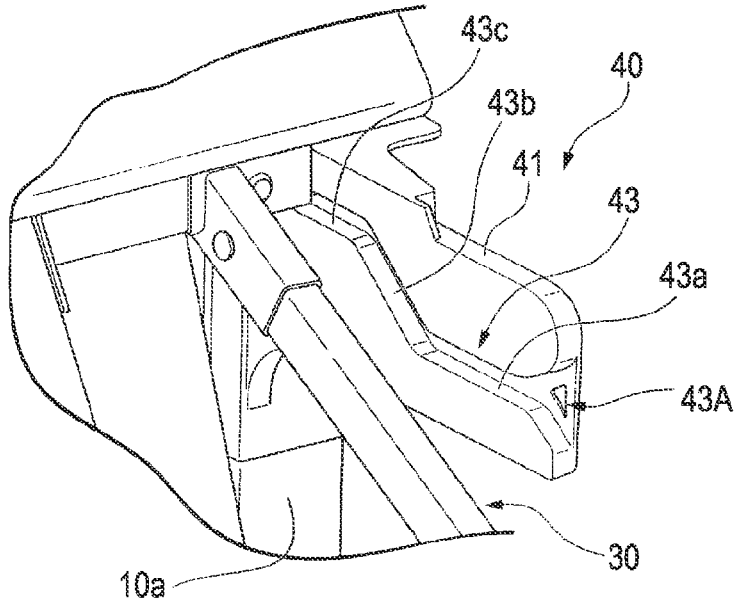
FIG. 6 is a diagram illustrating a state after the attachment frame and the boss have been engaged with each other, according to an embodiment of the invention.

FIG. 5 is a diagram illustrating a state prior to the attachment frame 41 and the boss 42 being engaged with each other, according to this embodiment of the invention. FIG. 6 is a diagram illustrating a state after the attachment frame 41 and the boss 42 have been engaged with each other, according to this embodiment of the invention.

The attachment frames 41 are each anchored to respective leg portions 10*a*, and extend a predetermined distance in the forward direction from those anchoring positions. As shown in FIG. 5, each attachment frame 41 includes a guidance groove (guidance portion) 43 that guides a corresponding boss 42. Each guidance groove 43, meanwhile, includes a first horizontal groove 43*a* that extends in the horizontal direction toward the rear side from an insertion section 43A into which the boss 42 is inserted; a sloped groove 43*b*, connected to the end of the first horizontal groove 43*a*, that slopes upward as the groove progresses toward the rear side; a second horizontal groove 43*c*, connected to the end of the sloped groove 43*b*, that extends in the horizontal direction toward the rear side; and a vertical groove 43*d*, connected to the end of the second horizontal groove 43*c*, that extends in the vertical direction. The insertion section 43A of each guidance groove 43 configures the starting side of the corresponding first horizontal groove 43*a* (the entry side of the guidance groove 43), and has a shape in which the width of the first horizontal groove 43*a* gradually expands as the groove progresses toward the starting side.

The bosses 42 are provided so as to protrude a predetermined distance on both sides of the upper frame section 32*a* of the stacker 30, and each boss 42 is configured so as to engage with the attachment frame 41 by being guided along a corresponding guidance groove 43. To be more specific, as shown in FIGS. 5 and 6, the configuration is such that each boss 42 is introduced into the guidance groove 43 from the expanded insertion section 43A, passes through the first horizontal groove 43*a* and the sloped groove 43*b*, and upon reaching the end of the second horizontal groove 43*c*, is biased upward by a lockstay (elastic structure member) 50, serving as a biasing unit (discussed later), thus engaging with the end of the vertical groove 43*d*.

The lockstays 50 are, as shown in FIG. 2, constructed between respective side frame sections 31*b* of the first grounded frame 31 and side frame sections 32*b* of the second grounded frame 32.

Figure 7:
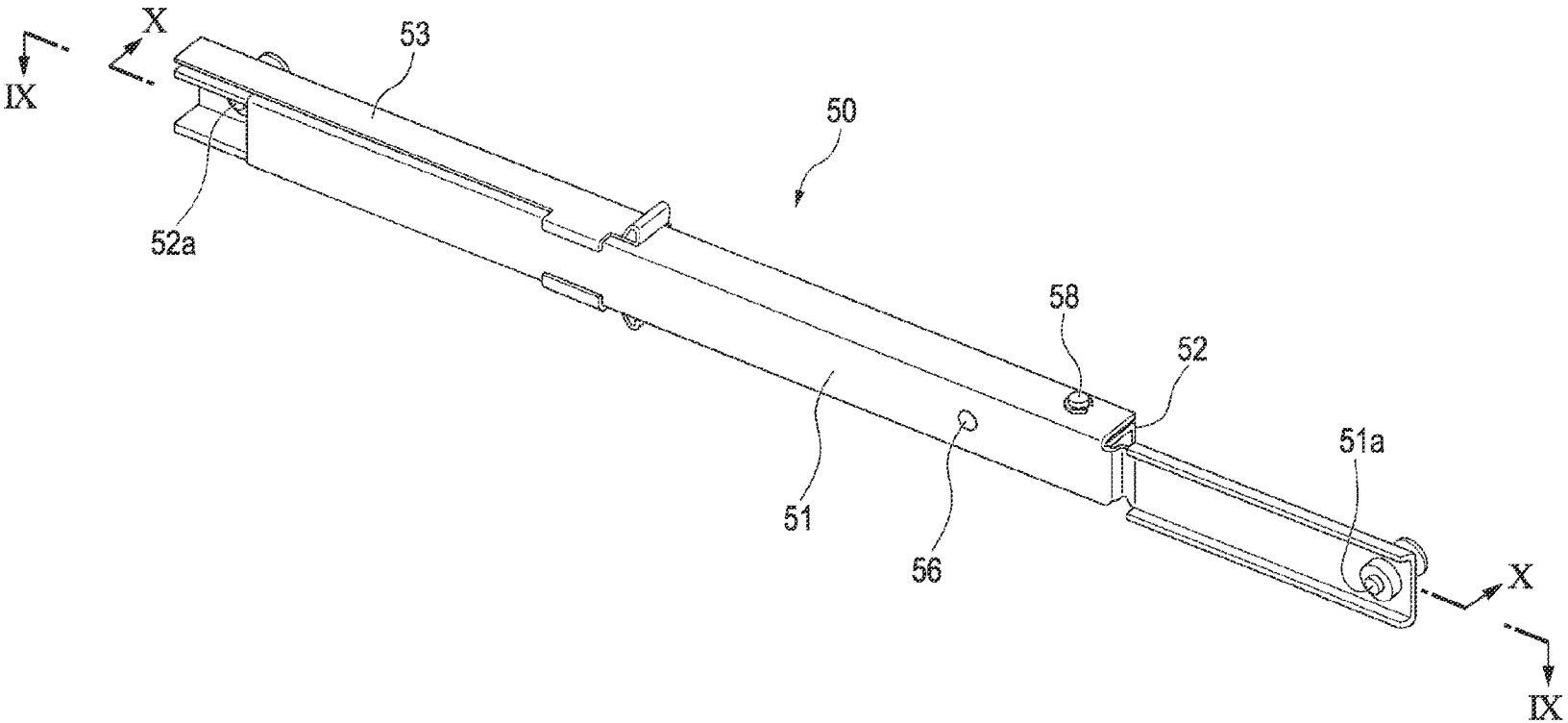
FIG. 7 is a perspective view of a lockstay provided in a stacker according to an embodiment of the invention.
Figure 8:
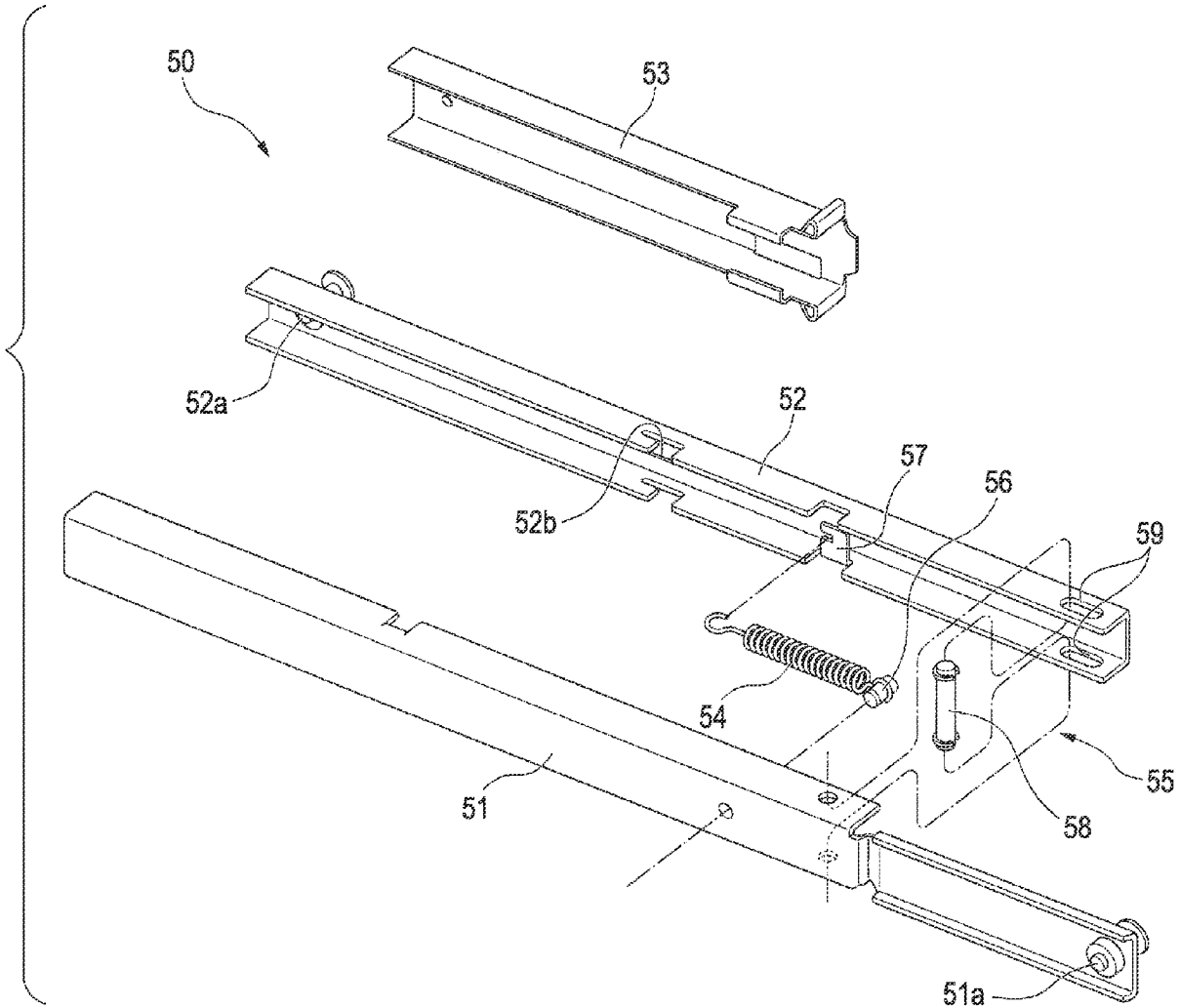
FIG. 8 is a perspective view illustrating a lockstay in a broken-down state according to an embodiment of the invention.
Figure 9:
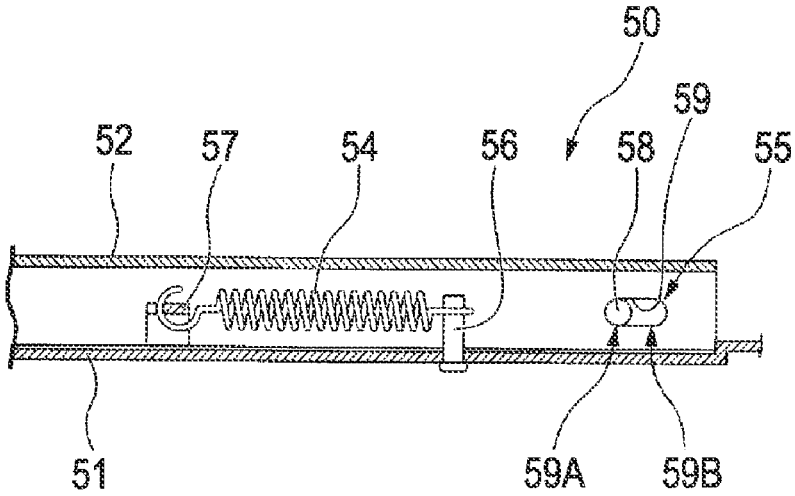
FIG. 9 is a cross-sectional view taken along the IX-IX line shown in FIG. 7.
Figure 10:
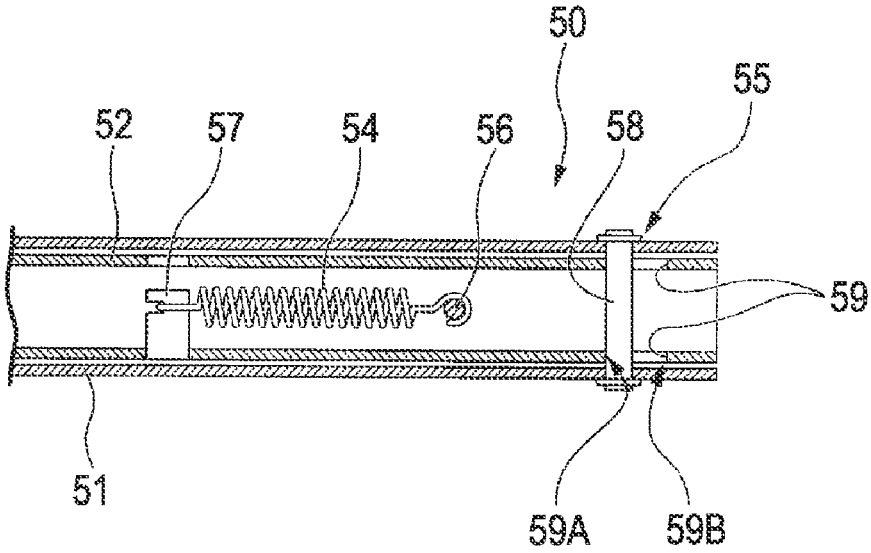
FIG. 10 is a cross-sectional view taken along the X-X line shown in FIG. 7.

FIG. 7 is a perspective view of the lockstay 50 provided in the stacker 30 according to this embodiment of the invention. FIG. 8 is a perspective view illustrating the lockstay 50 in a broken-down state according to this embodiment of the present invention. FIG. 9 is a cross-sectional view taken along the IX-IX line shown in FIG. 7. FIG. 10 is a cross-sectional view taken along the X-X line shown in FIG. 7.

Each lockstay 50 includes, as shown in FIGS. 7 and 8, a first slide frame 51 and a second slide frame 52 that are combined so as to be capable of freely sliding relative to each other in the lengthwise direction. One end of the first slide frame 51 is affixed to the side frame section 31*b* in a freely-rotatable state via a screw 51*a*. One end of the second slide frame 52 is affixed, along with a cover frame 53, to the side frame section 32*b* in a freely-rotatable state via a screw 52*a*. The cover frame 53 is configured so as to cover a slide elongated hole 52*b*, provided in the second slide frame 52, into which the screw 52*a* slides when the stacker 30 is folded up, and so that the first slide frame 51 and the second slide frame 52 can slide freely.

Each lockstay 50 also includes, as shown in FIG. 8, a coil spring 54 that biases the first slide frame 51 and the second slide frame 52 so as to constrict in the sliding direction, and a regulation portion 55 that regulates the slide stroke of the first slide frame 51 and the second slide frame 52 to within a predetermined range. One end of the coil spring 54 is anchored to a stop shaft 56 provided in the first slide frame 51, whereas the other end of the coil spring 54 is anchored to a bent portion 57 in which part of the second slide frame 52 is bent toward the inside thereof. The regulation portion 55 includes a slide shaft 58 anchored to the first slide frame 51, and a pair of slide elongated holes 59, provided in the second slide frame 52, in which the slide shaft 58 slides. The slide elongated holes 59 extend in a predetermined distance in the lengthwise direction of the second slide frame 52.

As shown in FIGS. 9 and 10, the lockstay 50 is usually in a state in which the slide shaft 58 is located at one end portion 59A of the slide elongated holes 59 due to the bias of the coil spring 54. The lockstay 50 is configured so that during this state, the degree to which the frame structure 34 is opened is regulated so that the height of the bosses 42 provided in the stacker 30 and the height of the end of the vertical grooves 43*d* are in a relationship in which the respective heights are equal. Meanwhile, when an external force is applied to the frame structure 34 and the slide shaft 58 is positioned at the other end portion 59B of the slide elongated holes 59, the degree to which the frame structure 34 is opened is regulated so that the height of the bosses 42 provided in the stacker 30 and the height of the insertion section 43A (first horizontal groove 43*a*) are in a relationship in which the respective heights are equal.

Next, operations for attaching the stacker 30 to the discharge section 20 will be described in detail with reference to FIGS. 11A to 11C.

Figure 11A:
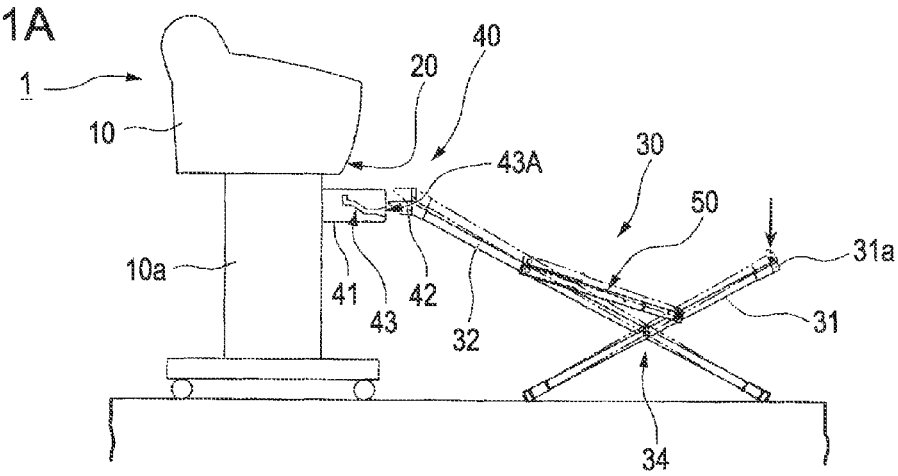
FIGS. 11A to 11C are diagrams illustrating the attachment of a stacker to a discharge section as time passes, according to an embodiment of the invention.
Figure 11B:
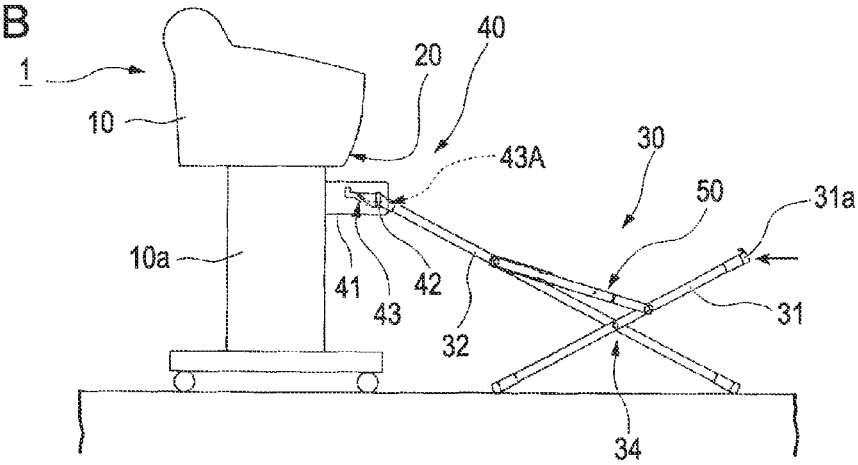
Figure 11C:
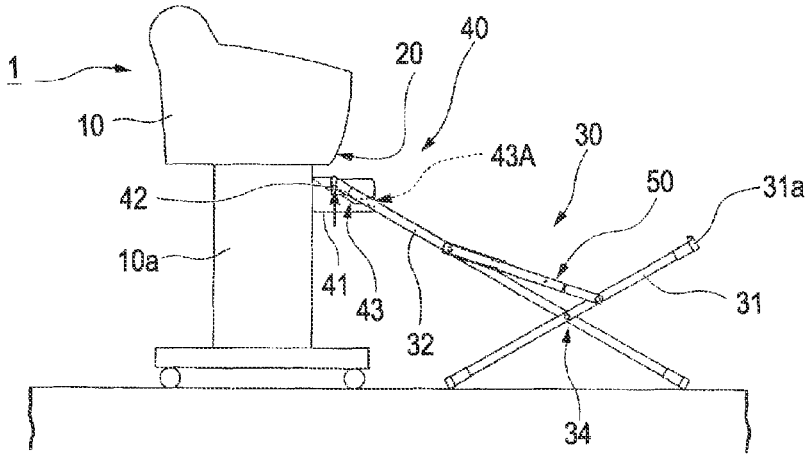

FIGS. 11A to 11C are diagrams illustrating the attachment of the stacker 30 to the discharge section 20 as time passes, according to this embodiment of the invention.

As shown in FIG. 11A, first, a user applies force, from above, onto the upper frame section 31*a* of the first grounded frame 31 in the stacker 30. When this force is applied to the frame structure 34 from above, the frame structure 34 is capable of moving so that the first grounded frame 31 and the second grounded frame 32 open. With the stacker 30 configured as described thus far, when a force is applied to the first grounded frame 31 from above and the first grounded frame 31 is moved, the second grounded frame 32 also moves simultaneously therewith due to the effects of the frame structure 34; accordingly, the bosses 42 can be moved with ease by operating the first grounded frame 31 on the opposite side of the second grounded frame 32 in which the bosses 42 are provided.

When a space opens up between the first grounded frame 31 and the second grounded frame 32, a tensile force of the lockstays 50 arranged at the space is applied. Due to this tensile force, when the lockstays 50 extend, the slide shafts 58, which are located at the one end portions 59A of the slide elongated holes 59 due to the bias of the coil springs 54, move toward the other end portions 59B of the slide elongated holes 59 while resisting the bias and causing the coil springs 54 to elastically deform. When the slide shafts 58 are located at the other end portions 59B of the slide elongated holes 59, the lockstays 50 stop extending. In this state, the lockstays 50 regulate the opening of the frame structure 34 so that the height of the bosses 42 provided in the stacker 30 and the height of the insertion sections 43A are in a relationship in which the respective heights are equal.

Next, as shown in FIG. 11B, the user advances the stacker 30 while still applying pressure from above so that the bosses 42 enter into the guidance grooves 43 provided in the attachment frames 41. At this time, the amount of depression caused by the application of force to the stacker 30 is regulated by the regulation portions 55; as a result, the height of the insertion sections 43A in the guidance grooves 43 and the height of the bosses 42 are the same when the stacker 30 is depressed, making it possible to smoothly insert the bosses 42 into the guidance grooves 43. Meanwhile, because the insertion sections 43A of the guidance grooves 43 are formed so that their widths gradually expand as the grooves progress toward the entry sides into which the bosses 42 enter, the bosses 42 can easily enter into the insertion sections 43A even if the height of the bosses 42 as regulated by the regulation portion 55 is not highly precise.

Once the bosses 42 have entered into the first horizontal grooves 43*a* from the insertion section 43A due to the advancement of the stacker 30, the user stops applying force to the stacker 30 from above. When this force is released, the bosses 42 are biased in the upward direction by the lockstays 50, and as the stacker 30 advances further, the bosses 42 pass through the first horizontal grooves 43*a* and the sloped grooves 43*b*, rising along the vertical grooves 43*d* from the ends of the second horizontal grooves 43*c*. To be more specific, when the force applied by the user is released, the lockstays 50 contract due to the restitution force of the coil springs 54. When the lockstays 50 contract, the slide shafts 58 located at the other end portions 59B of the slide elongated holes 59 move toward the one end portions 59A of the slide elongated holes 59 due to the biasing force of the coil springs 54. When the slide shafts 58 are located at the one end portions 59A of the slide elongated holes 59, the lockstays 50 stop contracting. In this state, the lockstays 50 regulate the opening of the frame structure 34 so that the height of the bosses 42 provided in the stacker 30 and the height of the ends of the vertical grooves 43*d* are in a relationship in which the respective heights are equal.

In other words, when the force applied by the user is released, the bosses 42 rise along the vertical grooves 43*d* and make contact with the ends of the guidance grooves 43 (the ends of the vertical grooves 43*d*), as shown in FIG. 11C. Through this, the attachment frames 41 and the bosses 42 engage with each other, and the positioning and attachment of the stacker 30 to the discharge section 20 is complete. Note that the engagement state of the attachment frames 41 and the bosses 42 can easily be visually confirmed because the attachment frames 41 extend a predetermined distance in the forward direction from the leg portions 10*a*, and thus it can be confirmed whether or not the engagement is complete.

Meanwhile, the reverse of the procedure described thus far is employed when removing the stacker 30 from the discharge section 20. In other words, the state of engagement between the attachment frames 41 and the bosses 42 and easily be released by retracting the stacker 30 while applying, from above, a force to the upper frame section 31*a* of the first grounded frame 31 in the stacker 30. Furthermore, space can be conserved when the stacker 30 is not in use by folding up the removed stacker 30 as shown in FIG. 3.

Accordingly, the ink jet printer 1 according to the aforementioned embodiment has the discharge section 20 that discharges the recording paper P that has undergone a recording process and the stacker 30 that receives the recording paper P discharged from the discharge section 20, and includes the engagement mechanism 40 that attaches the stacker 30 to the discharge section 20 in a removable state. The engagement mechanism 40 has the attachment frames 41 provided in the discharge section 20; the bosses 42, provided in the stacker 30, that engage with the corresponding attachment frames 41; and the guidance grooves 43 that guide the bosses 42 into the corresponding attachment frames 41 and extend in at least an upward direction. The bosses 42 are biased, by the lockstays 50 provided in the stacker 30, in the upward direction so as to move in the guidance grooves 43; and when an external force that opposes the biasing force of the lockstays 50 is applied to the stacker 30 and that external force is released, the bosses 42 rise due to the biasing force, are guided by the corresponding guidance grooves 43, and engage with the corresponding attachment frames 41, thus positioning and attaching the stacker 30 to the discharge section 20.

Through this, according to this embodiment, it is possible to achieve the ink jet printer 1, in which the large-sized stacker 30 can easily be attached to the discharge section 20.

Although an exemplary embodiment of the invention has been described thus far with reference to the drawings, the invention is not intended to be limited to the aforementioned embodiment. The forms, combinations, and so on of the various constituent elements illustrated in the aforementioned embodiment are merely exemplary, and many variations based on design requirements and the like are possible without departing from the essential spirit of the invention.

For example, although the aforementioned embodiment described an example in which the recording apparatus is the ink jet printer 1, the recording apparatus is not limited to an ink jet printer, and may instead be a device such as a copier, a facsimile machine, or the like.

What is claimed is:

1. A recording apparatus having a discharge section that discharges a recording medium that has undergone a recording process and a stacker that receives the recording medium discharged from the discharge section, the recording apparatus comprising:

an engagement mechanism that attaches the stacker to the discharge section in a removable state, wherein the engagement mechanism includes:

a first engagement portion provided in the discharge section;

a second engagement portion, provided in the stacker, that engages with the first engagement portion;

a guidance portion that guides the second engagement portion into the first engagement portion and extends in at least an upward direction, and a biasing unit that is provided in the stacker and biases the second engagement portion in the upward direction so as to move in the guidance portion with the stacker grounded; and when an external force that opposes the biasing force of the biasing unit is applied to the stacker and that external force is released, the second engagement portion rises due to the biasing force, is guided by the guidance portion, and engages with the first engagement portion.

2. The recording apparatus according to claim 1, wherein the stacker includes a frame structure provided with a first grounded frame, one end of which makes contact with the ground, and a second grounded frame, one end of which makes contact with the ground, that intersect with each other, the grounded frames being connected to each other so as to be capable of freely rotating central to an axis at the point of intersection; and the biasing unit includes an elastic structure member, constructed between the first grounded frame and the second grounded frame, that instigates the biasing force so that the other end of the first grounded frame rises.

3. The recording apparatus according to claim 2, wherein the second engagement portion is provided in one of the first grounded frame and the second grounded frame.

4. The recording apparatus according to claim 2, wherein an insertion section of the guidance portion, into which the second engagement portion is inserted, is located at a predetermined height; and the elastic structure member includes a regulation portion that regulates the rotational amount of the second grounded frame relative to the first grounded frame so that the height of the second engagement portion when the external force is applied thereto is the same as the height of the insertion section.

5. The recording apparatus according to claim 4, wherein the insertion section of the guidance portion, into which the second engagement portion is inserted, is formed so that the width of the guidance portion gradually increases toward an entry side into which the second engagement portion enters.

6. The, recording apparatus according to claim 1, wherein the guidance portion has an insertion section that is arranged at a position lower than the first engagement portion.

* * * * *